US010765596B1

(12) United States Patent
Hess

(10) Patent No.: US 10,765,596 B1
(45) Date of Patent: Sep. 8, 2020

(54) ORAL STIMULATOR DEVICE

(71) Applicant: GUMMER LLC, Palm Harbor, FL (US)

(72) Inventor: Michael A. Hess, Palm Harbor, FL (US)

(73) Assignee: GUMMER LLC, Palm Harbor, FL (US)

( * ) Notice: Subject to any disclaimer, the term of this patent is extended or adjusted under 35 U.S.C. 154(b) by 171 days.

(21) Appl. No.: 15/808,037

(22) Filed: Nov. 9, 2017

Related U.S. Application Data

(60) Provisional application No. 62/419,577, filed on Nov. 9, 2016.

(51) Int. Cl.
*A61H 23/02* (2006.01)
*A61H 19/00* (2006.01)
*A61H 7/00* (2006.01)

(52) U.S. Cl.
CPC ..... *A61H 23/02* (2013.01); *A61H 7/004* (2013.01); *A61H 19/32* (2013.01); *A61H 2201/0188* (2013.01); *A61H 2201/1692* (2013.01)

(58) Field of Classification Search
CPC ..... A61H 19/30; A61H 19/50; A61H 23/02; A61H 13/00; A61H 2201/0228; A61H 23/00
See application file for complete search history.

(56) References Cited

U.S. PATENT DOCUMENTS

| | | | | |
|---|---|---|---|---|
| 1,828,434 | A | 10/1931 | Reiss | |
| 4,123,844 | A | 11/1978 | Kurz | |
| 4,348,178 | A | 9/1982 | Kurz | |
| 5,030,098 | A | 7/1991 | Branford | |
| 6,382,815 | B1 | 5/2002 | Klearman et al. | |
| 6,572,569 | B2 | 6/2003 | Klein | |
| 6,645,164 | B2 | 11/2003 | Manska | |
| 2011/0185525 | A1* | 8/2011 | Stapelbroek | A61C 7/08 15/167.1 |
| 2013/0237749 | A1 | 9/2013 | Lee et al. | |
| 2014/0123421 | A1* | 5/2014 | Minano Fernandez | A46B 9/045 15/110 |
| 2014/0275759 | A1 | 9/2014 | Lee et al. | |
| 2015/0065929 | A1* | 3/2015 | Walker | A61H 13/00 601/139 |

* cited by examiner

*Primary Examiner* — Christine H Matthews

(57) ABSTRACT

An oral stimulating device is inserted within a mouth of an individual and engages over the teeth. The oral stimulating device comprises a general U-shaped mouthpiece for engaging the teeth of the individual. A plurality of protruding knobs are coupled to the general U-shape mouthpiece. A vibrating device and an electric current source are within the general U-shaped mouthpiece for emitting vibration from the general U-shape mouthpiece. The plurality of protruding knobs and the emitting vibration provides oral stimulation.

12 Claims, 16 Drawing Sheets

ORAL STIMULATOR DEVICE

CROSS-REFERENCE TO RELATED APPLICATIONS

This application claims benefit of U.S. Patent Provisional application No. 62/419,577 filed Nov. 9, 2016. All subject matter set forth in provisional application No. 62/419,577 is hereby incorporated by reference into the present application as if fully set forth herein.

BACKGROUND OF THE INVENTION

Field of the Invention

This invention relates to stimulating devices and more particularly to an oral stimulating device.

Description of the Related Art

Individuals may seek a means for improving oral stimulation. There have been many in the prior art who have attempted to provide a device for improving oral stimulation solve these problems with varying degrees of success. None, however completely satisfies the requirements for a complete solution to the aforestated problem. The following U. S. Patents are attempts of the prior art to solve this problem.

U.S. Pat. No. 1,826,434 to Reiss discloses a device comprising an elastic pad having an opening, a pair of loosely connected plates adapted to be inserted within the opening having substantially semi-circular portions and an eccentric arranged within the opening and adapted to rotate therein for vibrating and oscillating the plates.

U.S. Pat. No. 4,123,844 to Kurz discloses an orthodontic appliance in the form of a vibrational pad is provided. The pad is held in place in the mouth of the patient by an external head gear. A vibrational electric motor is mounted on the head gear, and the motor is mechanically coupled to vibrational elements within the mouth pad. The mouth pad is used in conjunction with conventional orthodontic appliances, and it serves to vibrate the teeth being moved by the conventional orthodontic appliances so as to disseminate heavy orthodontic pressures of the conventional appliance to a larger boney mass resulting in lighter more physiological pressure in a larger area. This will increase the speed and efficiency of the orthodontic movement, minimize pain to the patient, and reduce root resorption and horizontal bone loss.

U.S. Pat. No. 4,348,178 to Kurz discloses an orthodontic appliance is provided which consists of a tooth positioner mouth piece which contains impressions of the upper and lower teeth of a patient in corrected positions, and an electric motor mounted on the extra oral bow of a usual orthodontic headgear, and mechanically coupled to the mouth piece for introducing vibrations into the mouth piece. In a second embodiment, the mouth piece is pulsed by an electrically energized hydraulic pump.

U.S. Pat. No. 5,030,098 to Branford discloses a malleable plate is provided with a cover of resilient cushioning material for insertion between the user's upper and lower teeth. The plate may be of a perforate nature with an extension for securement to a base adapted for attachment to a hand held vibrator. The plate is deformed by the user's bite to effect positive securement to the teeth.

U.S. Pat. No. 6,382,815 to Klearman et al. discloses an energized body jewelry including alternative embodiments designed to be worn by persons who have piercings in their bodies, as well as for those who do not have piercings. In one embodiment, the jewelry may be worn by a person with a piercing by attaching the jewelry with a barbell style piercing including a slotted retainer sized to carry the jewelry. In that same embodiment, the jewelry alternatively, through the use of an elastomeric band attachment means, may be worn by a person who does not have a piercing. The jewelry is energized such that it may vibrate, illuminate, or perform other functions requiring energy from some extracorporeal source such as a battery.

U.S. Pat. No. 6,572,569 to Klein discloses a sexual aid device comprising a battery powered electric vibrator which attaches to the user's tongue. The first embodiment attaches to the tongue using a post which is inserted through a hole previously pierced in the tongue. The assembled device is shaped roughly like a dumbbell consisting of a post with retainers mounted at either end. Post has a diameter narrow enough to fit through the tongue hole, but the retainers have larger diameter and cannot slip through the hole. An electric vibrator motor is incorporated into one of the retainers. At least one of the retainers must be removable to allow device insertion. An electric battery may be mounted in the same retainer as the vibrator motor or in the other retainer. The second embodiment attaches to the tongue using suction, constriction, and friction. The front end of the device houses a vibrator mechanism comprising a vibrator motor, battery, and switch in a moisture resistant housing. A pliable plastic mouthpiece is mounted at the rear of the device. The interior of mouthpiece forms a tongue cup into which the user inserts the tongue. Tongue cup, when partially evacuated of air, acts as the means of attachment to the tongue. A sealing lip circles the rim of tongue cup. Sealing lip both constricts the tongue and forms an airtight seal against the skin of the tongue. Concentric friction ridges circle the interior of tongue cup. Friction ridges grip the tongue and act as secondary air seals.

U.S. Pat. No. 6,645,164 to Manska discloses a vibrating oral sex enhancement device comprising a mouthpiece and a controller. The mouthpiece retains a vibrator that is connected to the controller by electrical conductors, whereas the controller comprises a battery compartment, a battery and a switch and functions to power the vibrator. In use, a surface of the mouthpiece adjacent the vibrator contacts and imparts vibrations to the user's tongue, which results in increased sexual pleasure to the user's partner during oral sex. The device is comfortably stabilized in the user's mouth such that vibrations are optimally imparted to the tongue while leaving the tongue free to move with respect to the mouthpiece. In certain embodiments the mouthpiece is stabilized by integral features of the mouthpiece itself. In other embodiments, the mouthpiece is stabilized by external structures such as elastic straps that are adapted to engage a posterior surface of the user's head, neck or ears in such manner that a rearward, stabilizing force is imparted to the mouthpiece.

United States Patent Application 2013/0237749 to Lee et al. discloses a sexual stimulator for oral sex is disclosed that includes a body and a motor. The body forms a clipping structure which can be clipped onto and worn on a mouth such that a fore part of the body is snug inside a wall of the mouth while the rear part of the body will snug the exterior face. The stimulator facilitates the user to clip, wear and take off the stimulator and a micro-circuit control chip controls an output of a motor for different modes of vibration. In addition, the overall small size only occupies a little space within the mouth cavity without affecting the motions in the course of oral sex.

United States Patent Application 2014/0275759 to Lee et al. discloses an oral sex stimulator includes: a battery powered body including a battery compartment, a silicone cover and a one or more controls; and a tail attached to the body, wherein the tail includes a bend adjacent to the body, an elongated arm extending away from the bend, and a hooked end at the terminal end of the tail. In some embodiments, the body is a vibrating body. In others, the body includes a heating element.

United States Patent Application 2015/0065929 to Walker discloses a gum massaging mouthpiece includes a main body having a generally C-shaped base member that is in communication with an integrally formed inner and outer wall. A plurality of nubs are disposed along the mouthpiece so as to make contact with the gums of a user, and a plurality of electrically controlled vibrating elements provide a vibration force to the nubs for massaging the gums of a user.

Although the aforementioned prior art have contributed to the development of the art of oral stimulation, none of these prior art patents have solved the needs of this art.

Therefore, it is an object of the present invention to provide an improved apparatus for providing oral stimulation.

Another object of this invention is to provide an improved apparatus providing vibration for increasing the oral stimulation.

Another object of this invention is to provide an improved apparatus emitting a light radiation.

Another object of this invention is to provide an oral stimulating device that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an oral stimulating device for inserting within a mouth of an individual and engaging over the teeth comprises a primary member defining a lower surface, an upper surface, an interior surface and an exterior surface. A secondary member defines a lower surface, an upper surface, an interior surface and an exterior surface. An arcuate member defines a lower surface, an upper surface, an interior surface and an exterior surface. The arcuate member couples the primary member with the secondary member for defining a general U-shaped mouthpiece. A first plurality of lower protruding knobs are coupled to the lower surface of the primary member. A second plurality of lower protruding knobs are coupled to the lower surface of the secondary member. A third plurality of lower protruding knobs are coupled to the lower surface of the arcuate member. The first plurality of protruding knobs, the second plurality of protruding knobs and the third plurality of protruding knobs provide oral stimulation.

In a more specific embodiment of the invention, the general U-shaped mouthpiece includes a thermo-plastic material for deforming the general U-shaped mouthpiece after heating and molding to fit the teeth of the individual for preventing displacement of the general U-shaped mouthpiece relative to the teeth.

In another embodiment of the invention, a housing is coupled to the interior surface of the primary member, the interior surface of the secondary member and the interior surface of the arcuate member. The housing defines a lower surface, an upper surface and a rear surface. An electric light emitting device and an electric current source are within the housing for emitting light radiation thru the transparent material.

In another embodiment of the invention, a vibrating device and an electric current source are within the housing for emitting vibration from the general U-shape mouthpiece. The emitting vibration provides oral stimulation.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 23 2 is a right side view of FIG. 22 1;

FIG. 24 3 is a bottom view of FIG. 22 1;

Similar reference characters refer to similar parts throughout the several Figures of the drawings.

DETAILED DISCUSSION

Figure 1:
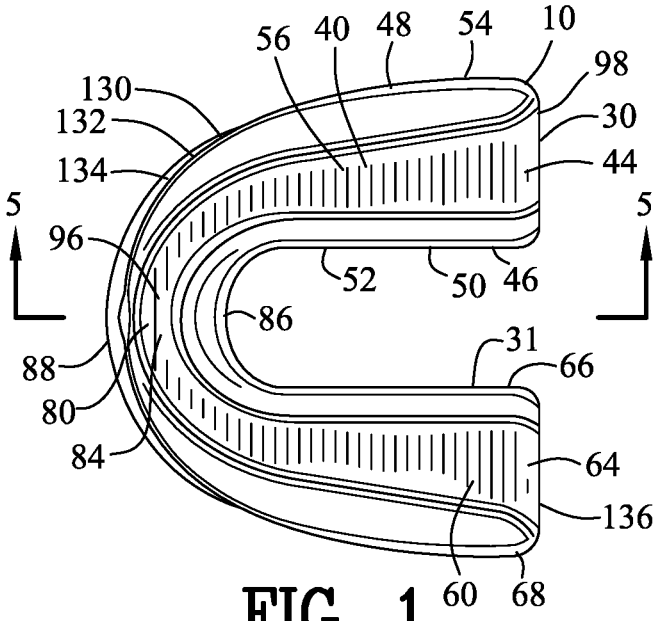
FIG. 1 is a top view of a first embodiment of an oral stimulating device incorporating the present invention.
Figure 2:
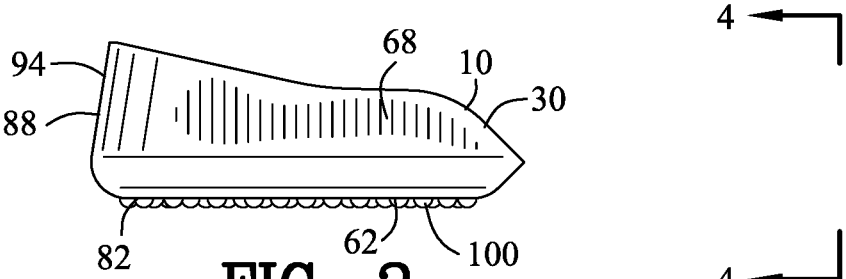
FIG. 2 is a right side view of FIG. 1.
Figure 3:
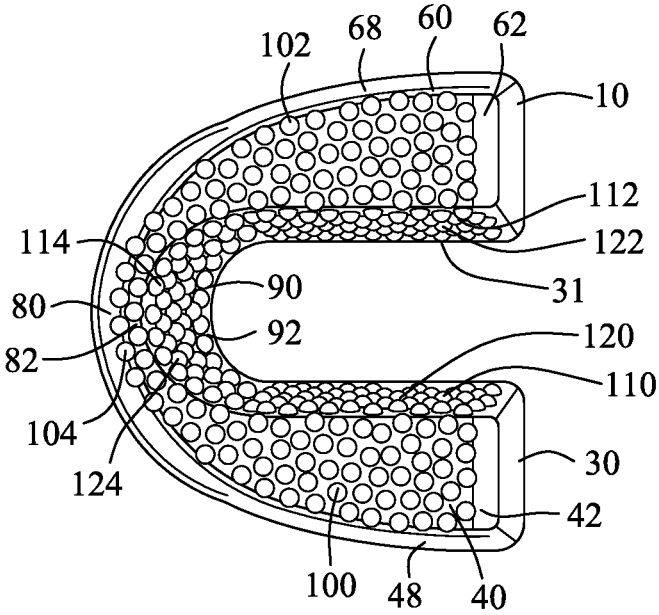
FIG. 3 is a bottom view of FIG. 1.
Figure 4:
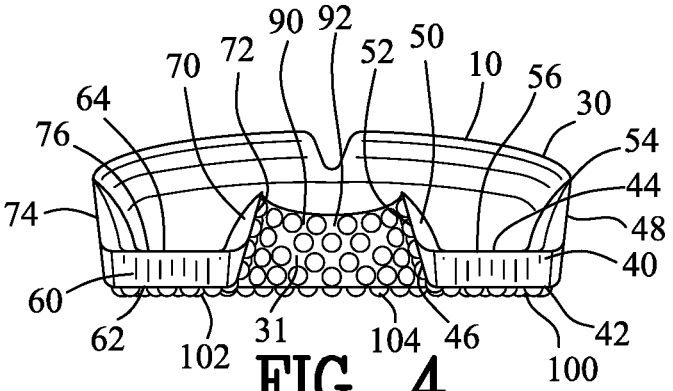
FIG. 4 is a view along line 4-4 in FIG. 2.
Figure 5:
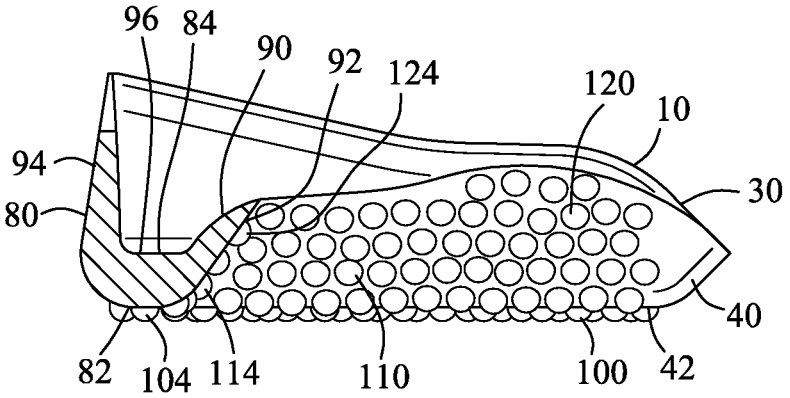
FIG. 5 is a sectional view along line 5-5 in FIG. 1.
Figure 6:
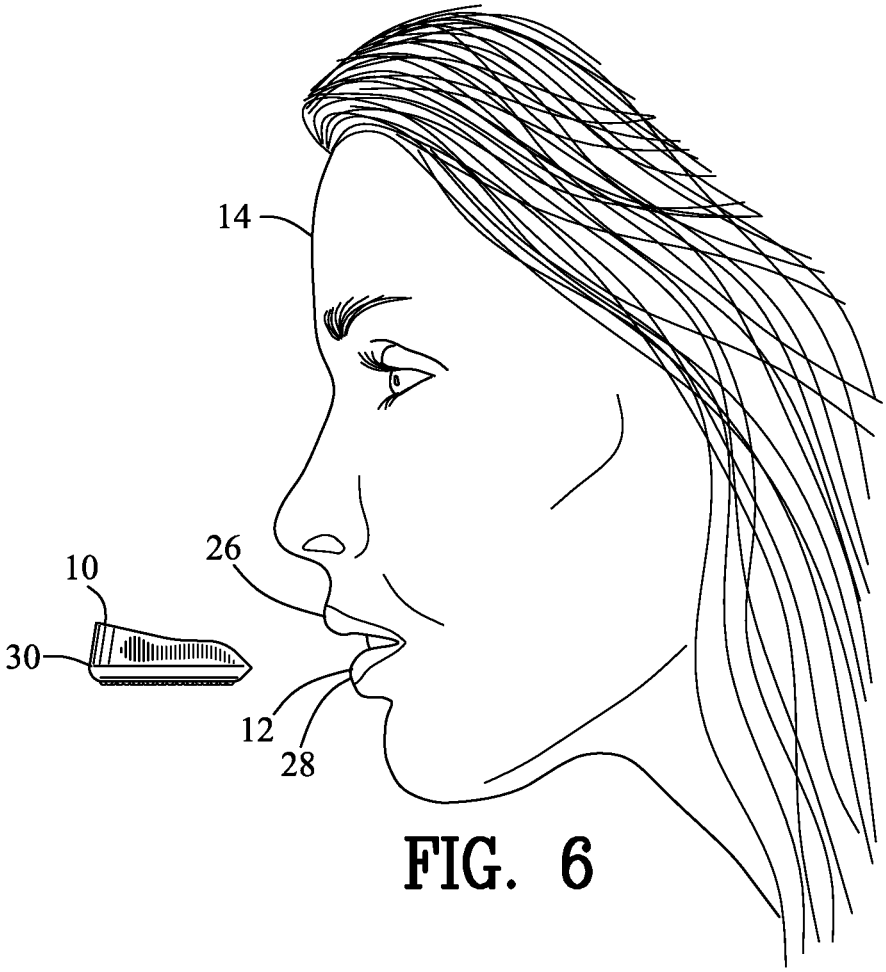
FIG. 6 is the view of FIG. 2 illustrating the oral stimulating device positioned for insertion into a mouth of an individual.
Figure 7:
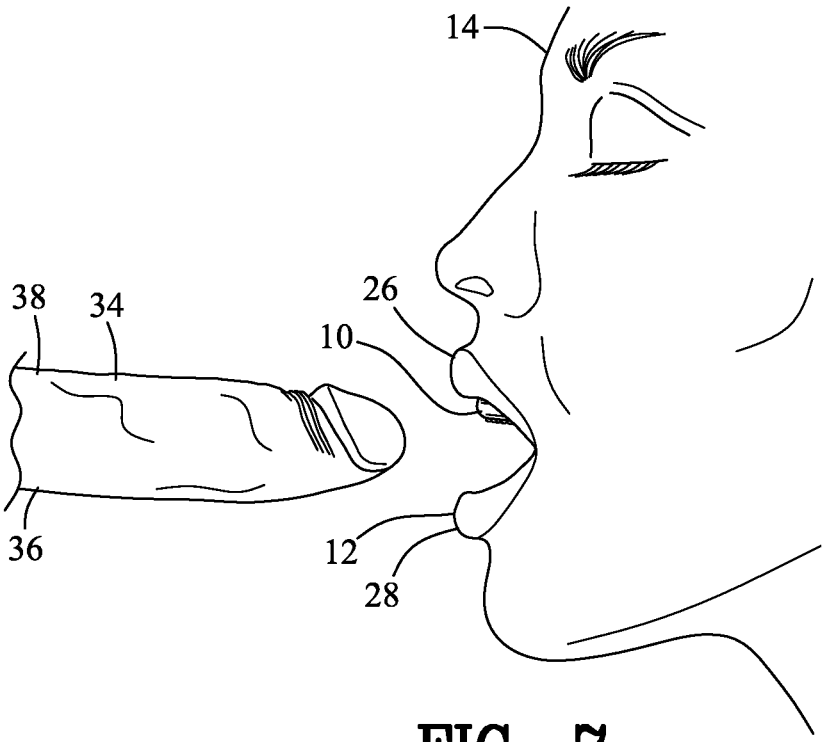
FIG. 7 is a view similar to FIG. 6 illustrating the oral stimulating device engaging the teeth of the individual for providing oral stimulation to a sexual organ of a second individual.
Figure 8:
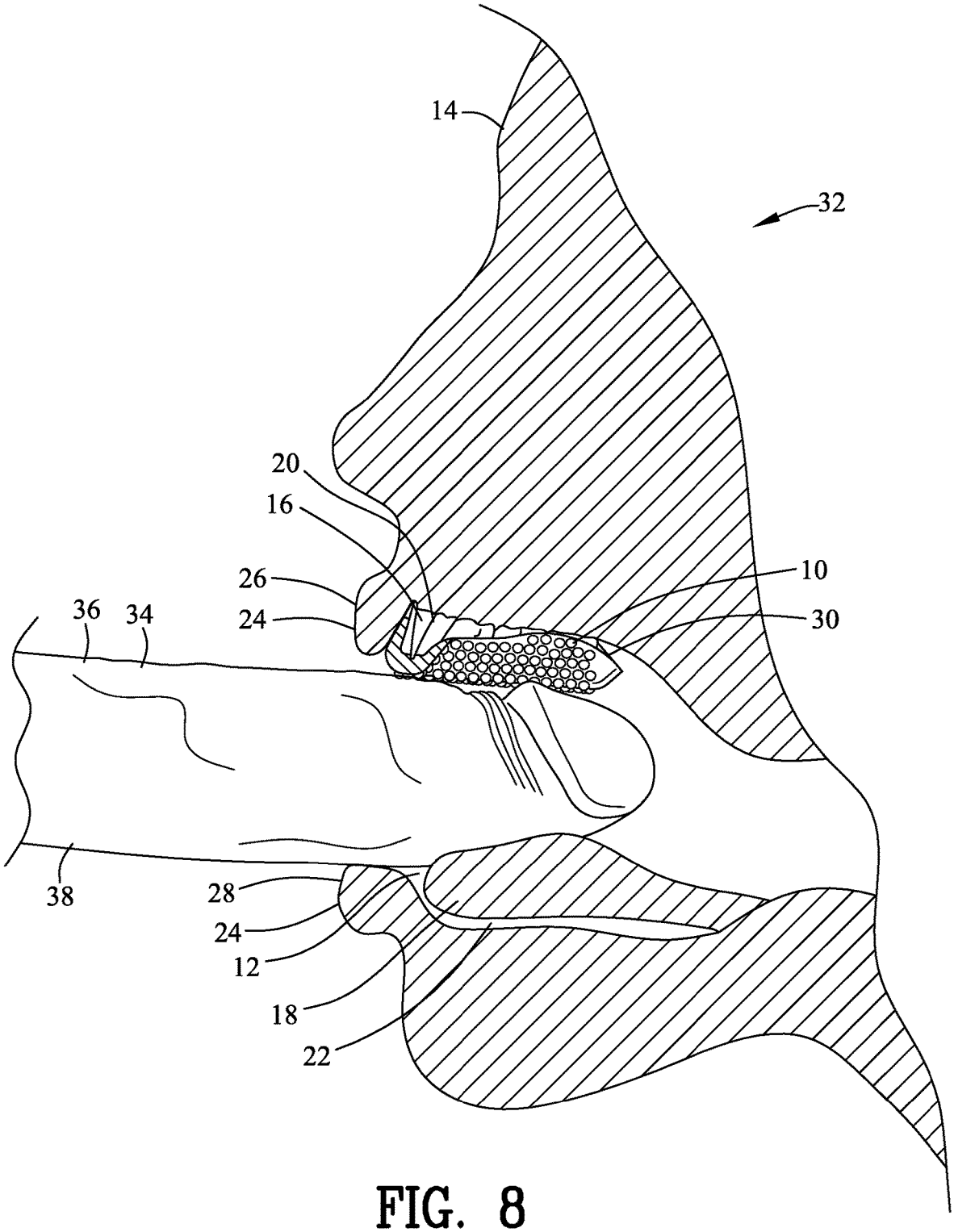
FIG. 8 is a sectional view of FIG. 7 illustrating the oral stimulating device contacting the sexual organ of the second individual for providing oral stimulation.
Figure 9:
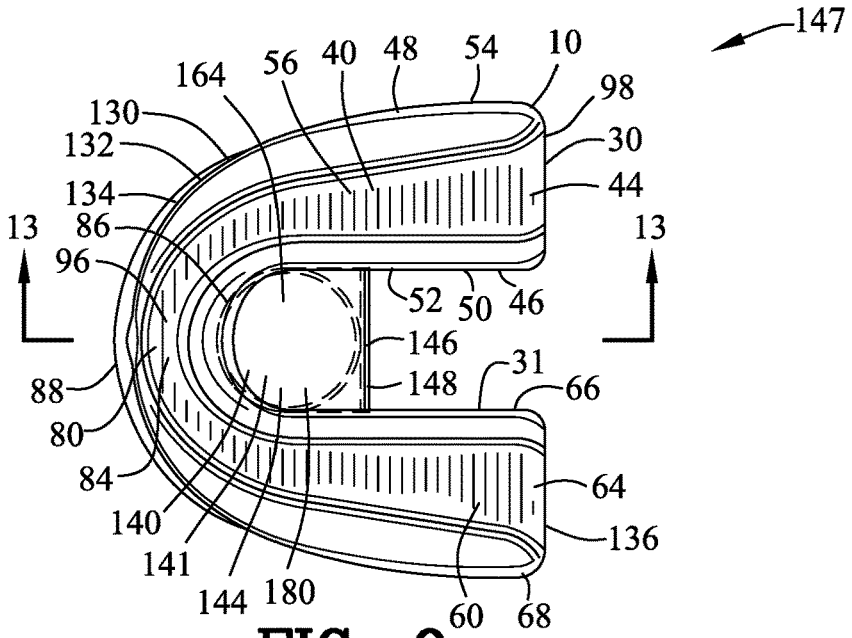
FIG. 9 is a top view of a second embodiment of an oral stimulating device incorporating the present invention.
Figure 10:
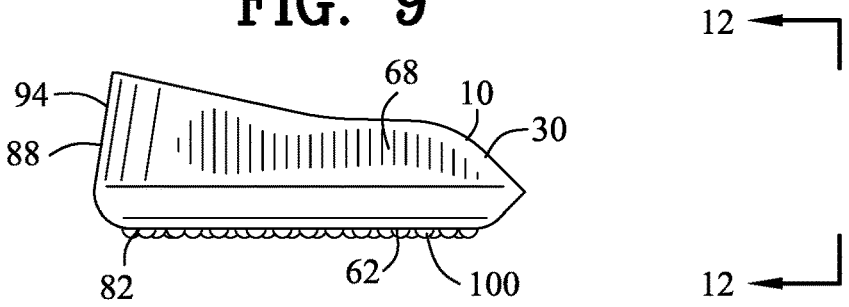
FIG. 10 is a right side view of FIG. 9.
Figure 11:
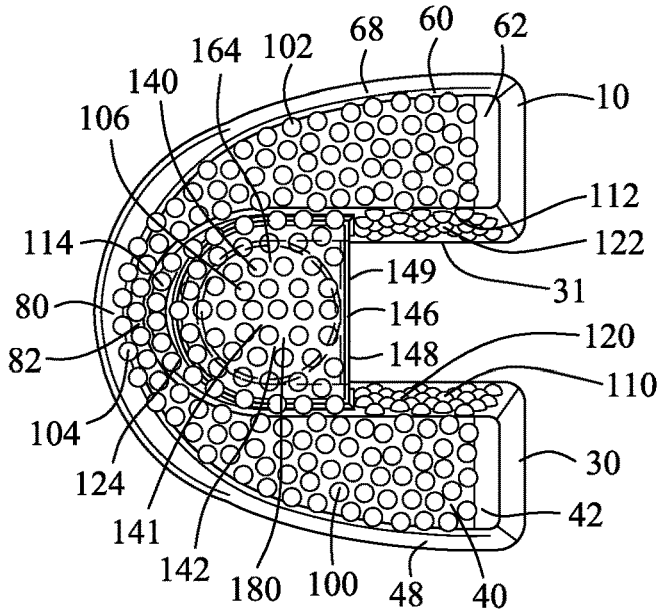
FIG. 11 is a bottom view of FIG. 9.
Figure 12:
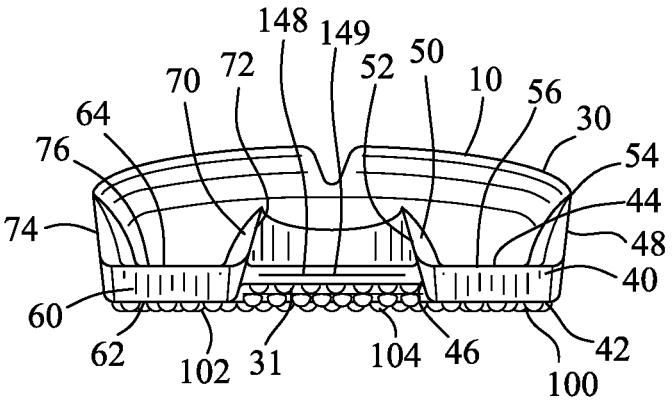
FIG. 12 is a view along line 12-12 in FIG. 10.
Figure 13:
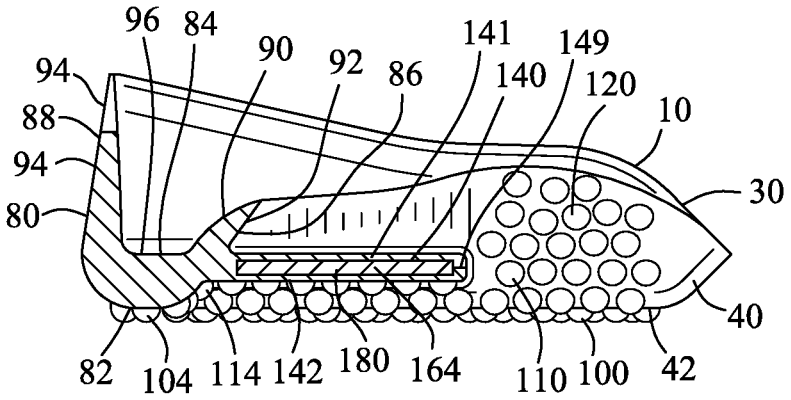
FIG. 13 is a sectional view along line 13-13 in FIG. 9.
Figure 14:
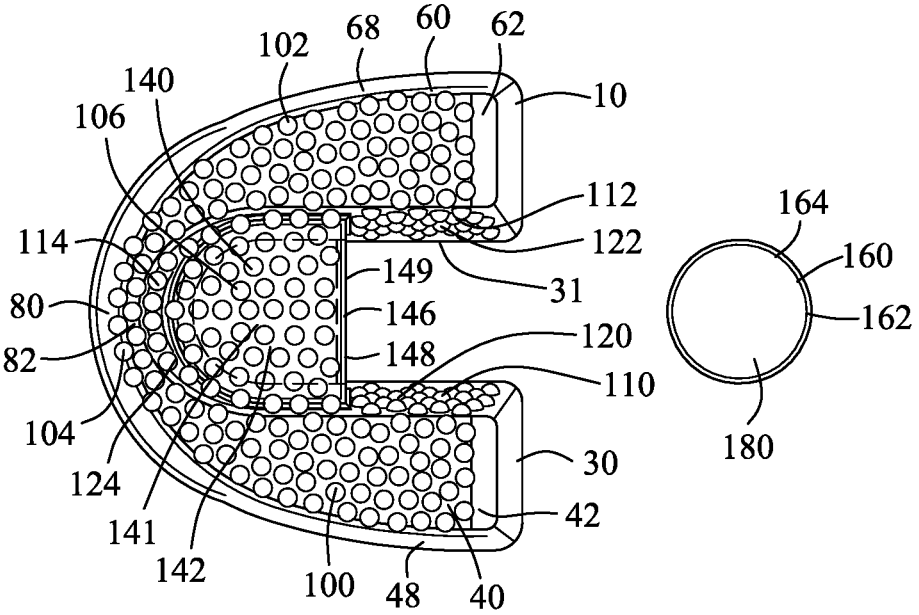
FIG. 14 is a view similar to FIG. 11 illustrating a vibrating device and electric current source positioned for insertion into the oral stimulating device.

FIGS. 1-21 illustrate an oral stimulating device 10 for inserting within a mouth 12 of an individual 14 and engaging over the teeth 16. The teeth 16 include upper teeth 20 and lower teeth 22. The individual 14 has a tongue 18. FIGS. 1-21 illustrate the oral stimulating device 10 engaging the upper teeth 20, however the oral stimulating device may engage the lower teeth 22. In addition, an oral stimulating device 10 may be utilized on the upper teeth 20 and an oral stimulating device 10 may be utilized on the lower teeth 22 simultaneously.

The oral stimulating device 10 comprises a primary member 40 defining a lower surface 42, an upper surface 44, an interior surface 46 and an exterior surface 48. A secondary member 60 defines a lower surface 62, an upper surface 64, an interior surface 66 and an exterior surface 68. An arcuate member 80 defines a lower surface 82, an upper surface 84, an interior surface 86 and an exterior surface 88. The arcuate member 80 couples the primary member 40 with the secondary member 60 for defining a general U-shaped mouthpiece 30. The general U-shaped mouthpiece 30 may include an internal general U-shaped endoskeleton 98 for increasing the stiffness of the general U-shaped mouthpiece 30. The internal general U-shaped endoskeleton 98 may extend through the primary member 40, the arcuate member 80 and the secondary member 60.

FIGS. 1-21 illustrate the oral stimulating device 10 including a first plurality of lower protruding knobs or nodules 100 coupled to the lower surface 42 of the primary member 40. A second plurality of lower protruding knobs or nodules 102 are coupled to the lower surface 62 of the secondary member 60. A third plurality of lower protruding knobs or nodules 104 are coupled to the lower surface 82 of the arcuate member 80. The first plurality of protruding knobs or nodules 100, the second plurality of protruding knobs or nodules 102 and the third plurality of protruding knobs or nodules 104 provide oral stimulation 32.

Preferably, the oral stimulating device 10 is utilized for stimulating a sexual organ 36 of a second individual 34. The sexual organ 36 may include a penis 38 as shown in FIGS. 7, 8, 16 and 21. However, the oral stimulating device 10 may utilized for stimulating other sexual organs by directly contact between the stimulating device 10 with a sexual organ or indirect contact though the lips 24 including the upper lip 26 or the lower lip 28 of the individual 14 and the sexual organ. The oral stimulating device 10 may assist in minimizing discomfort and pain caused to the penis 38 from the upper teeth 20 and/or the lower teeth 22. Furthermore, the oral stimulating device 10 may eliminate or reduce infections from oral bacteria transferred from a cut in the penis 38 due to contact between the upper teeth 20 and the penis 38 during oral sex.

The oral stimulating device 10 may include a first plurality of interior protruding knobs or nodules 110 are coupled to the interior surface 46 of the primary member 40. A second plurality of interior protruding knobs or nodules 112 are coupled to the interior surface 66 of the secondary member 60. A third plurality of interior protruding knobs or nodules 114 are coupled to the interior surface 86 of the arcuate member 80. The first plurality of interior protruding knobs or nodules 110, the second plurality of interior protruding knobs or nodules 112 and the third plurality of interior protruding knobs or nodules 114 provide further oral stimulation 32.

The oral stimulating device 10 may include a primary interior wall 50 coupled to the upper surface 44 of the primary member 40. A secondary interior wall 70 may be coupled to the upper surface 64 of the secondary member 60. An arcuate interior wall 90 may be coupled to the upper surface 84 of the arcuate member 80. A first plurality of wall protruding knobs or nodules 120 are coupled to an interior surface 52 of the primary interior wall 50. A second plurality of wall protruding knobs or nodules 122 are coupled to the interior surface 72 of the secondary interior wall 70. A third plurality of wall protruding knobs or nodules 124 are coupled to the interior surface 92 of the arcuate interior wall 90. The first plurality of wall protruding knobs or nodules 120, the second plurality of wall protruding knobs or nodules 122 and the third plurality of wall protruding knobs or nodules 124 provide further oral stimulation 32.

The general U-shaped mouthpiece 30 defines a mouthpiece channel 31. The mouthpiece channel 31 provides oral stimulation 32 in combination with the first plurality of wall protruding knobs or nodules 120, the second plurality of wall protruding knobs or nodules 122 and the third plurality of wall protruding knobs or nodules 124 provide oral stimulation 32.

The oral stimulating device 10 may include a primary exterior wall 54 coupled to the upper surface 44 of the primary member 40. A secondary exterior wall 74 is coupled to the upper surface 64 of the secondary member 60. An arcuate exterior wall 94 is coupled to the upper surface 84 of the arcuate member 80. The primary member 40, the primary interior wall 50 and the primary exterior wall 54 define a primary channel 56. The secondary member 60, the second interior wall 70 and the secondary exterior wall 74 define a secondary channel 76. The arcuate member 80, the arcuate interior wall 90 and the arcuate exterior wall 94 define an arcuate channel 96. The primary channel 56, the secondary channel 76 and the arcuate channel 96 encircle the upper teeth 20 or the lower teeth 22 for preventing displacement of the general U-shaped mouthpiece 30 relative to the teeth 16.

The oral stimulating device 10 may be constructed from a thermo-plastic material 130 for deforming the general U-shaped mouthpiece 30 after first heating and second molding to fit the teeth 16 of the individual 14 for preventing displacement of the general U-shaped mouthpiece 30 relative to the teeth 30. The thermo-plastic material 130 creates customized tooth impressions within the upper surface 44 of the primary member 40, the upper surface 64 of the secondary member 60 and the upper surface 84 of the arcuate member.

The oral stimulating device 10 may be constructed from a photoluminescence material 132 for emitting light radiation from the general U-shaped mouthpiece 30. More specifically, the photoluminescence material 132 may include phosphorescence 134 for emitting light radiation in the dark. The oral stimulating device 10 may include various non-transparent colors including but not limited to red, green, black, pink or a plurality of colors. The oral stimulating device 10 may include decorative images, messages and/or designs.

Alternatively, the oral stimulating device 10 may be constructed from a transparent material 136. A housing 140 may be coupled to the interior surface 46 of the primary member 40, the interior surface 66 of the secondary member 60 and the interior surface 92 of the arcuate member 80. The housing 140 defines a lower surface 142, an upper surface 144 and a rear surface 146. The general U-shaped mouthpiece 30 and the housing 140 preferably are constructed from an integral one-piece unit 147 of a silicone or other flexible materials.

Figure 15:
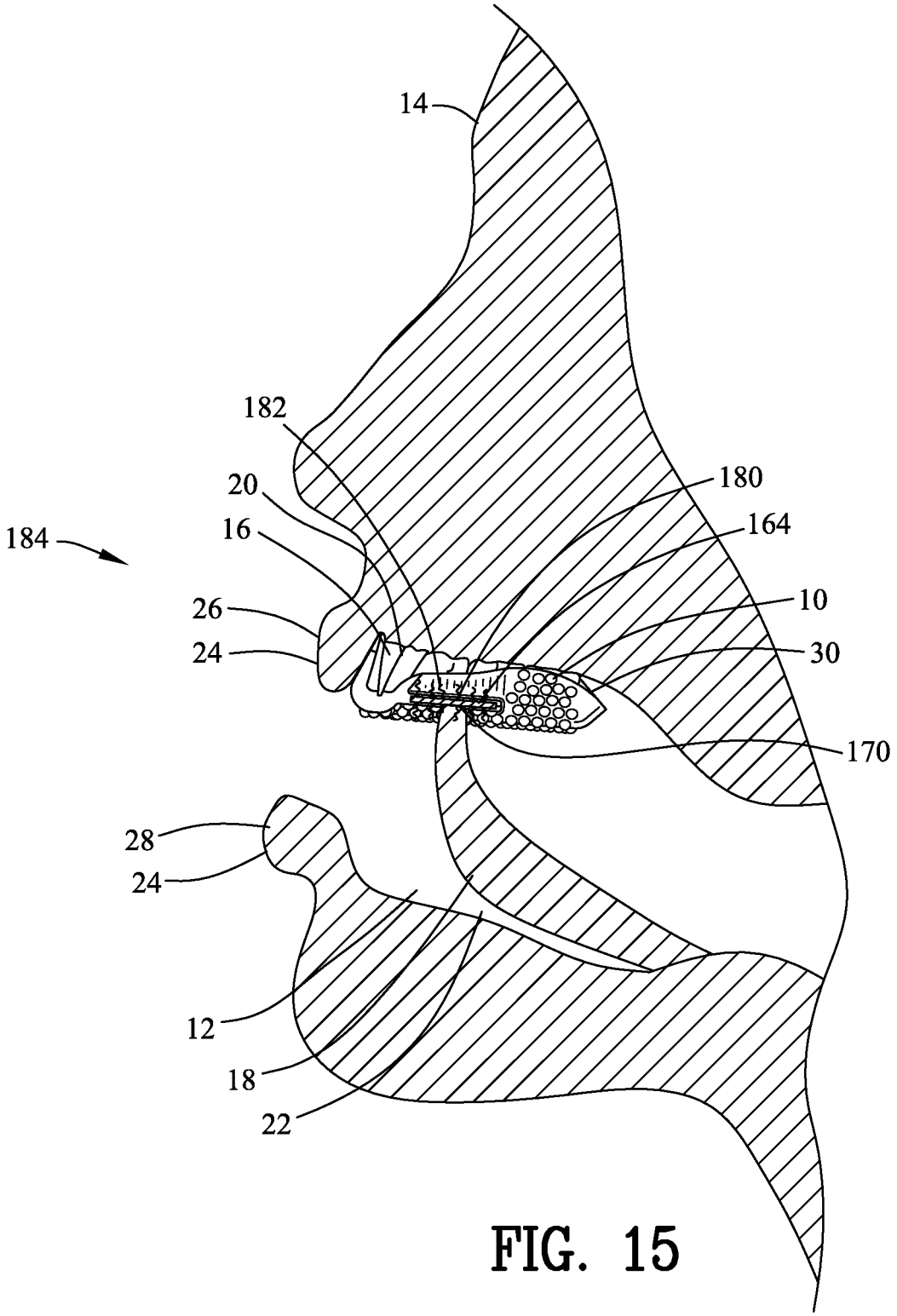
FIG. 15 is the view of FIG. 13 with oral stimulating device engaging the teeth of the individual and a tongue of the individual used to activate the vibrating device.
Figure 16:
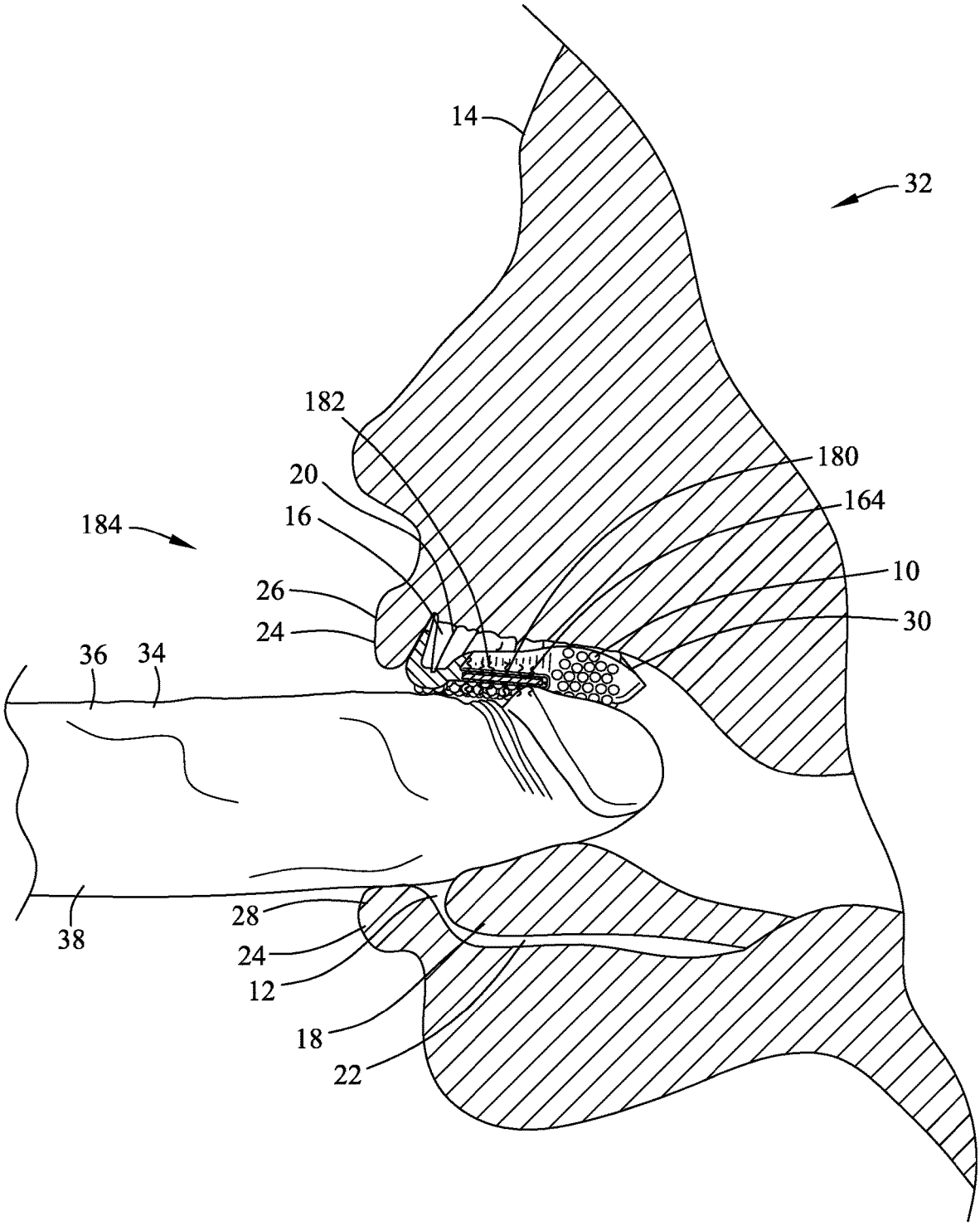
FIG. 16 is a view similar to FIG. 15 illustrating the oral stimulating device providing vibration to the sexual organ of the second individual for providing oral stimulation.
Figure 17:
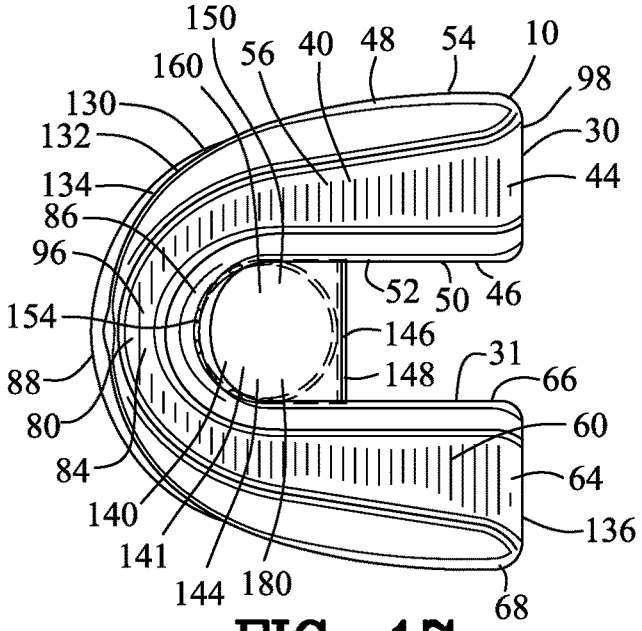
FIG. 17 is a top view of a third embodiment of an oral stimulating device incorporating the present invention.
Figure 18:
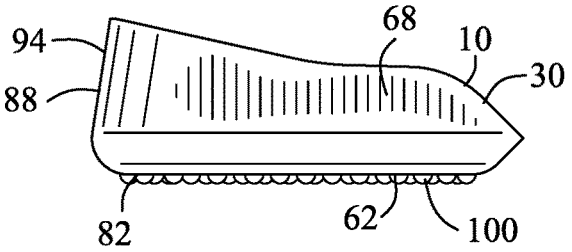
FIG. 18 is a right side view of FIG. 17.
Figure 19:
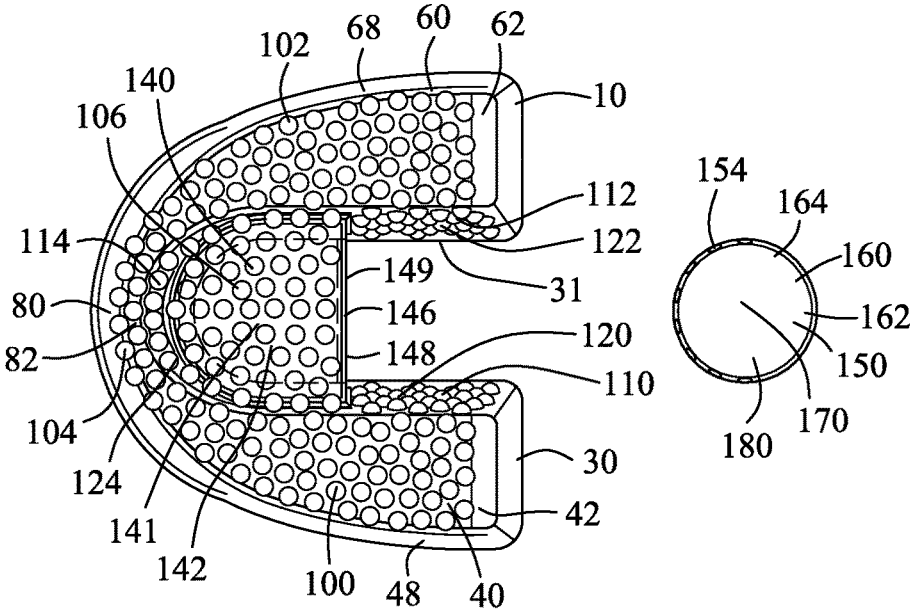
FIG. 19 is a bottom view of FIG. 17 illustrating an electric light emitting device and electric current source positioned for insertion into the oral stimulating device.
Figure 20:
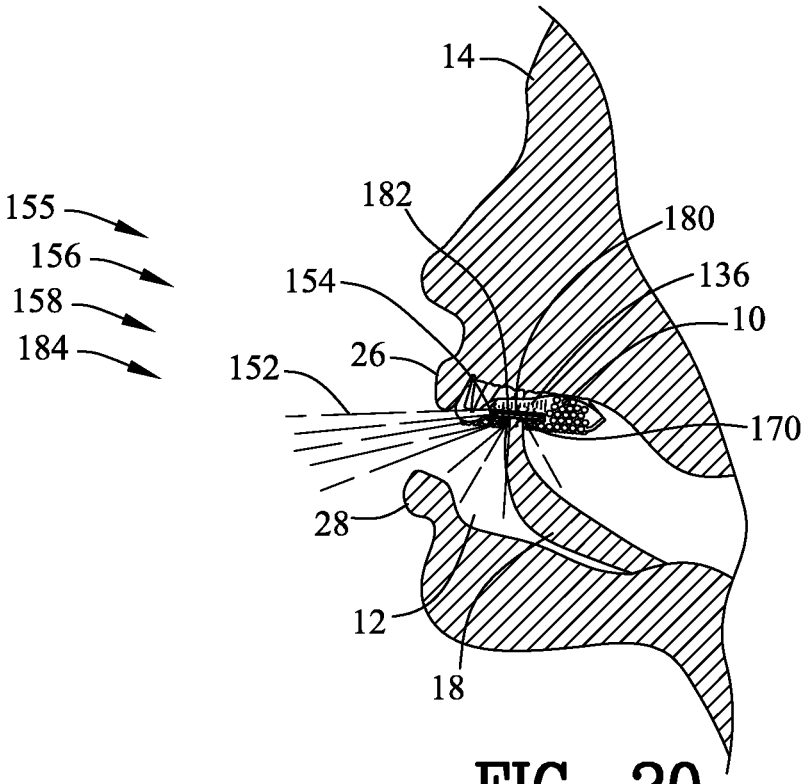
FIG. 20 is a section view of FIG. 17 with oral stimulating device engaging the teeth of the individual and a tongue of the individual used to activate the electric light emitting device.
Figure 21:
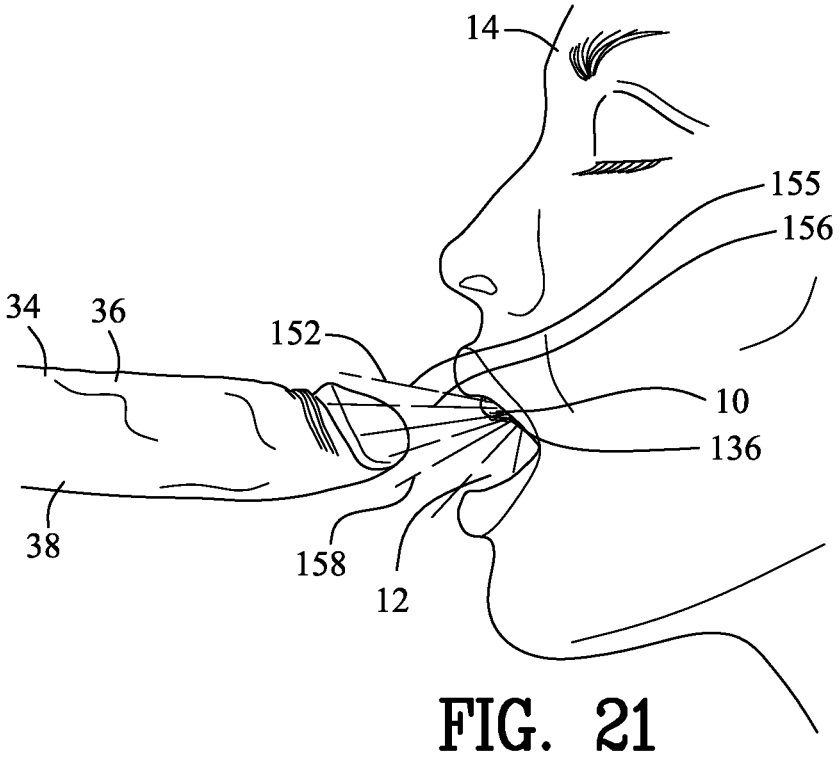
FIG. 21 is a view similar to FIG. 20 illustrating the oral stimulating device emitting light radiation from the mouth of the individual.
Figure 22:
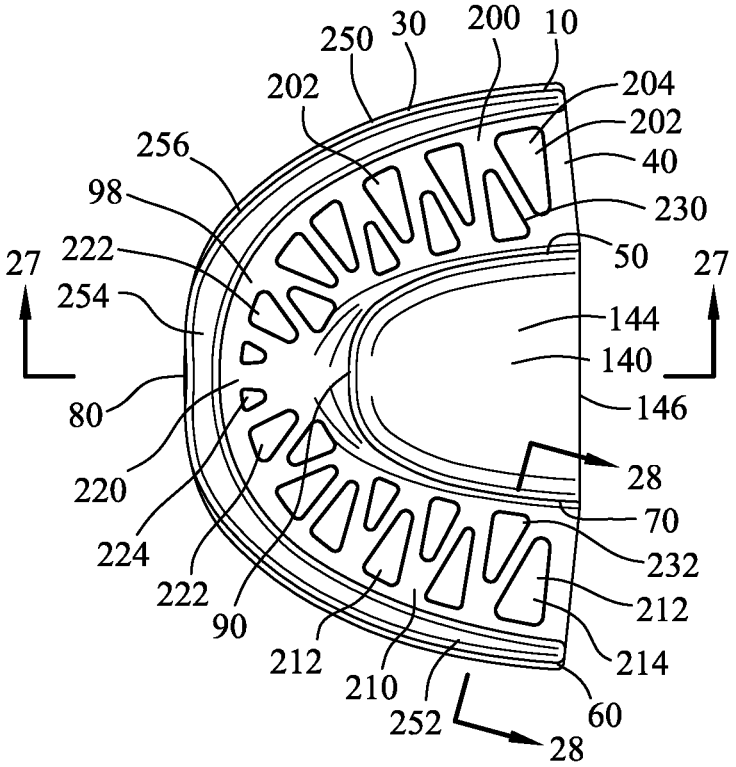
FIG. 22 is a top view of a fourth embodiment of an oral stimulating device incorporating the present invention.
Figure 23:
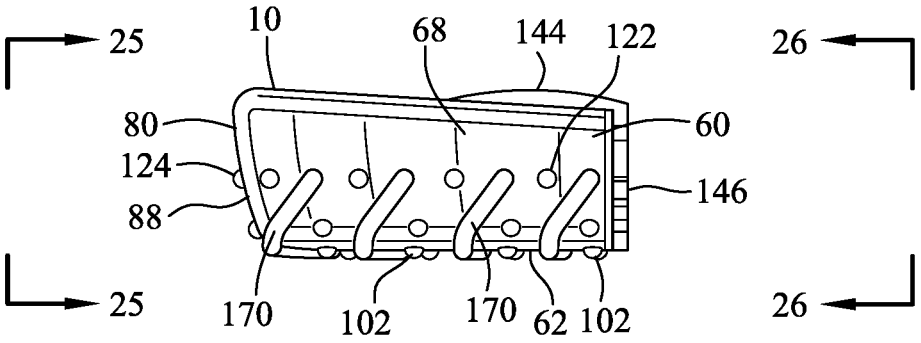
Figure 24:
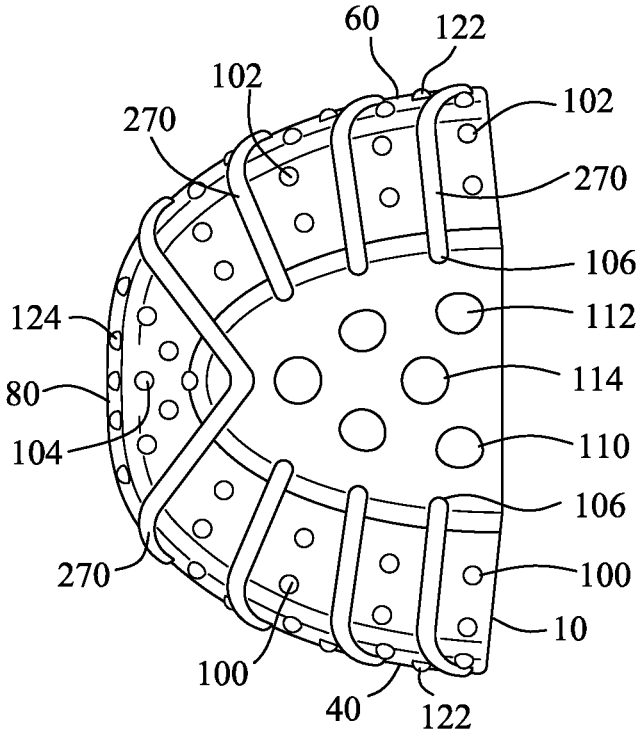
Figure 25:
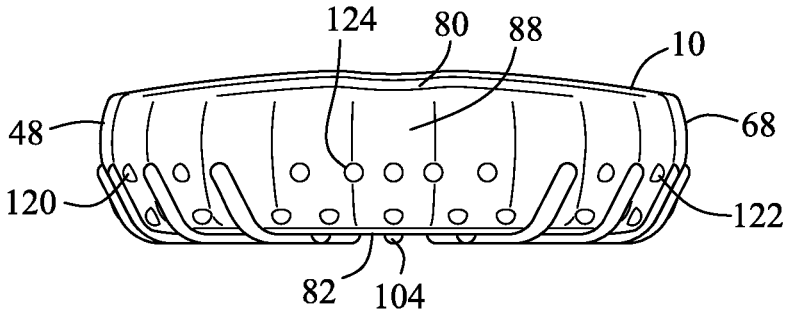
FIG. 25 is a front view of FIG. 22.
Figure 26:
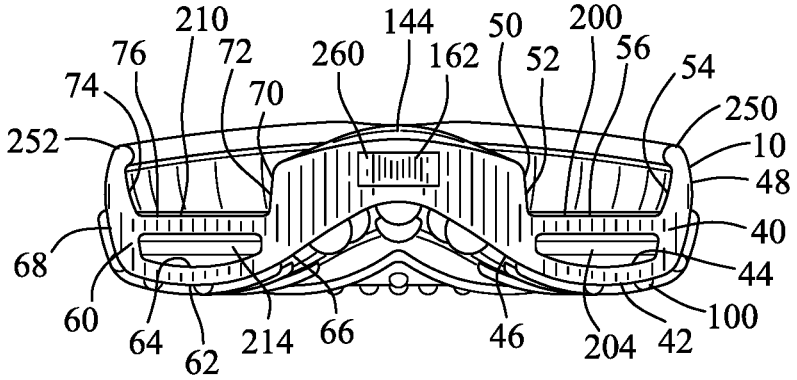
FIG. 26 is a rear view of FIG. 22.
Figure 27:
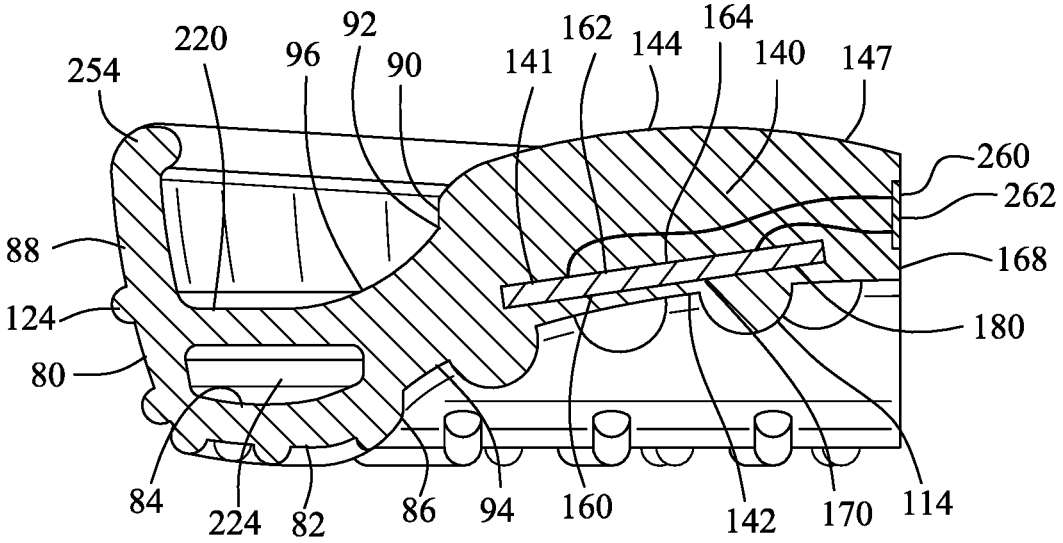
FIG. 27 is a sectional view along line 27-27 in FIG. 22.
Figure 28:
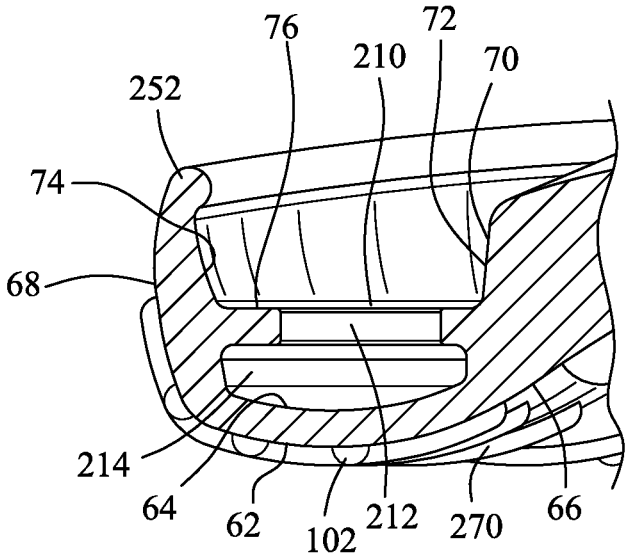
FIG. 28 is an enlarged portion of FIG. 27.
Figure 29:
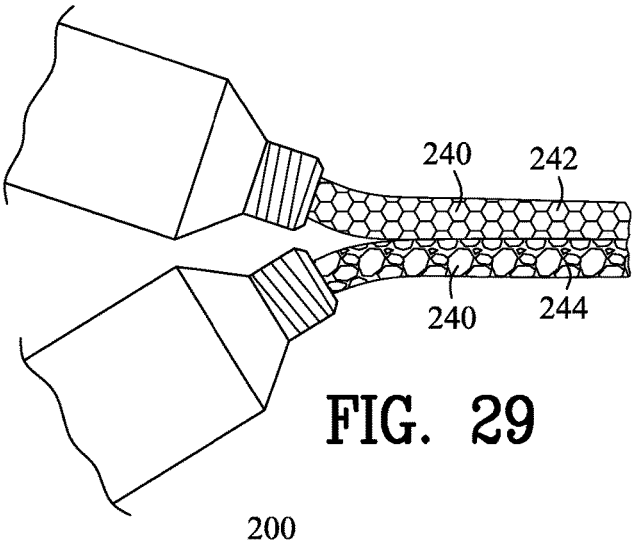
FIG. 29 is top view of a two part polyvinyl siloxane being dispensed.
Figure 30:
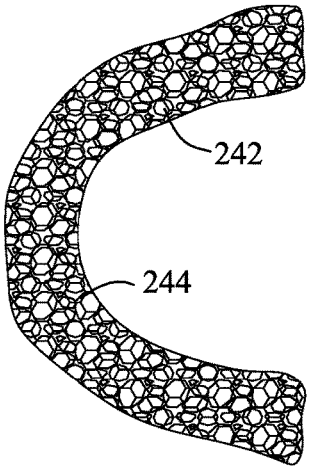
FIG. 30 is a top view of the two part polyvinyl siloxane of FIG. 29 being mixed and formed into a general U-shape.
Figure 31:
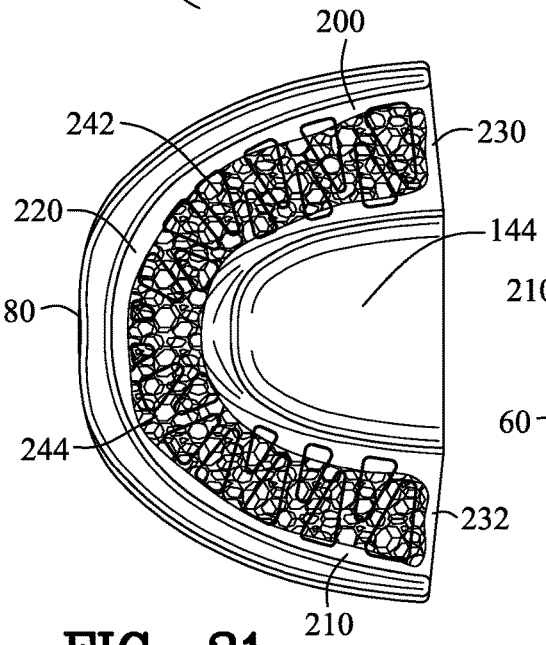
FIG. 31 is a view similar to FIG. 22 illustrating the mixed polyvinyl siloxane engaging the oral stimulating device.
Figure 32:
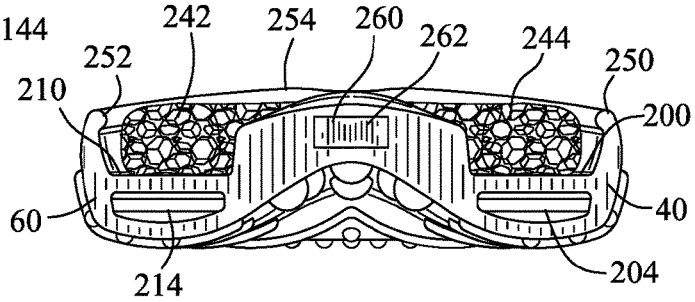
FIG. 32 is a rear view FIG. 31.
Figure 33:
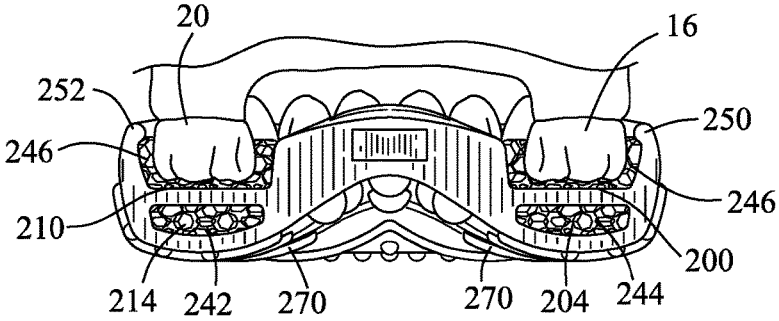
FIG. 33 is a view similar to FIG. 31 illustrating the upper teeth of the individual engaging the oral stimulating device for causing the polyvinyl siloxane to encircle the upper teeth and the oral stimulating device.
Figure 34:
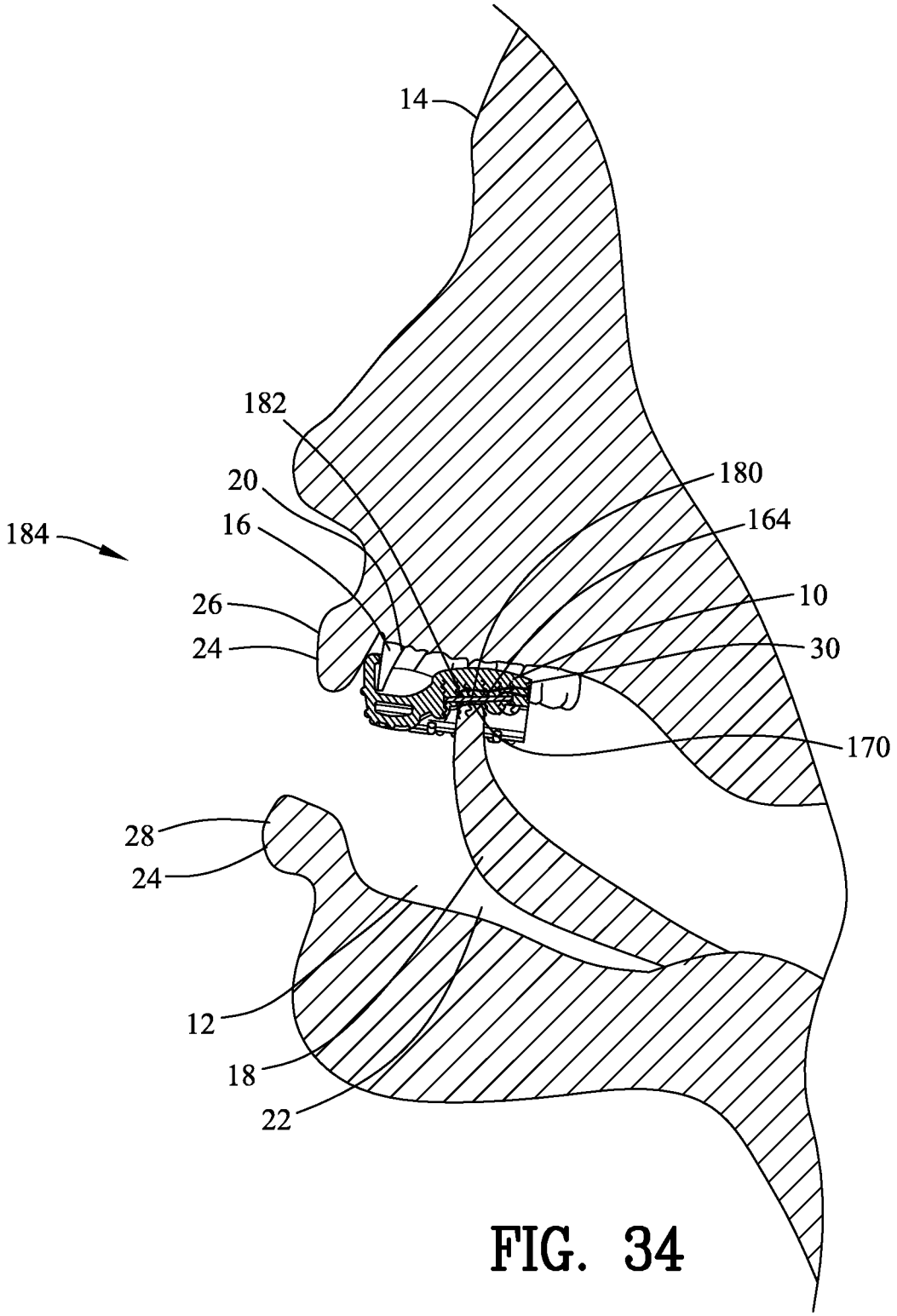
FIG. 34 is a view of FIG. 27 with the oral stimulating device engaging the teeth of the individual and a tongue of the individual used to activate the vibrating device.
Figure 35:
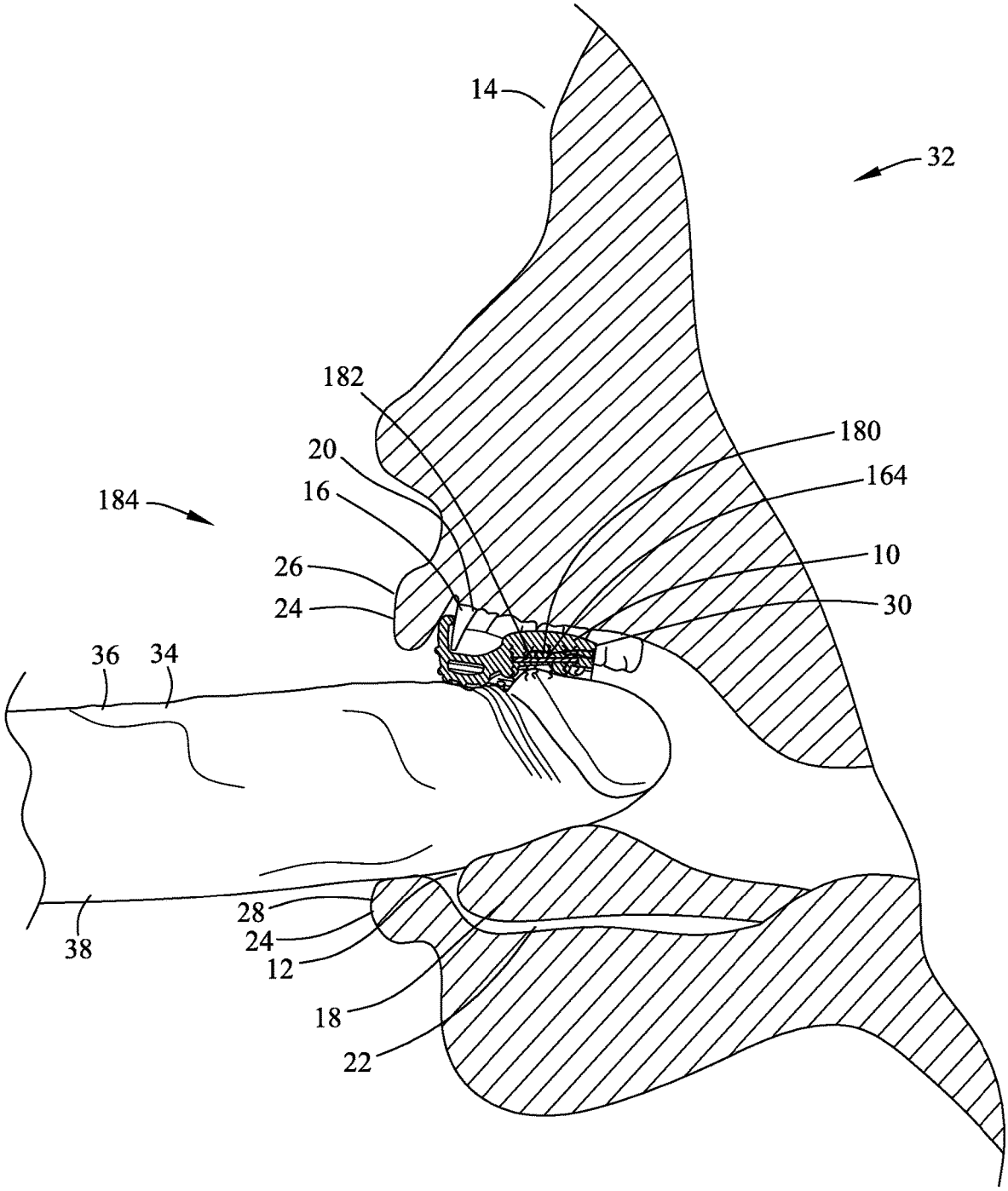
FIG. 35 is a view similar to FIG. 34 illustrating the oral stimulating device contacting the sexual organ of the second individual for providing oral stimulation.

As best shown in FIGS. 17-21, an electric light emitting device 150 and an electric current source 160 may be positioned within the housing 140 for emitting light radiation 152 thru the transparent material 136. The emitting light radiation 152 illuminates the interior of the mouth 12 and exits out from the mount 12 as best shown in FIGS. 20 and 21. The electric light emitting device 150 may include a plurality of LEDs 154 configured around a disk body 164. The electric light emitting device 150 may emit a plurality of colors 155, a plurality of illuminating patterns 156 and/or a plurality of illuminating brightness's 158. The electric current source 160 may include a battery 162 contained with the disk body 164. An electrical switch 170 may be utilized to electrically couple and decouple the electric light emitting device 150 from the electric current source 160. As shown in FIGS. 15 and 20, the electrical switch 170 may be coupled exterior to the disk body 164 such that the tongue 18 of the individual 14 can be utilized for activating the electrical switch 170. The electrical switch 170 may be depressed by the tongue 18 multiple times for varying the plurality of colors 154, a plurality of illuminating patterns 156 and/or a plurality of illuminating brightness's 158.

The rear surface 146 of the housing 140 may include a housing aperture 148 for inserting and removing the electric light emitting device 150 and the electric current source 160 relative to the general U-shaped mouthpiece 30. More specifically the rear surface 146 of the housing 140 may include a housing aperture 148 accessing a housing chamber 141 within the housing 140. The housing aperture 148 permits inserting and removing the electric light emitting device 150 and the electric current source 160 from the housing chamber 141 within the housing 140. The housing aperture 148 may include an aperture seal 149. The aperture seal 149 may include a gluing, an overlap channel closure or other forms of sealing.

In addition, the oral stimulating device 10 may a fourth plurality of lower protruding knobs or nodules 106 coupled to the lower surface 142 of the housing 140. The fourth plurality of protruding knobs or nodules 106 further provide oral stimulation 32.

As best shown in FIGS. 20 and 21, the oral stimulating device 10 may include a vibrating device 180 and the electric current source 160 within the housing 140 for emitting vibration 182 from the general U-shape mouthpiece 30. The emitting vibration 182 provides oral stimulation 32. The vibration 182 may provide direct oral stimulation by direct contact between the general U-shape mouthpiece 30 and the sexual organ 36 and/or indirect oral stimulation by indirect contact between the lips 24 of the individual 14 and the sexual organ 36.

Preferably, the vibrating device 180 and the electric current source 160 are positioned within the disk body 164. The vibrating device 180 may include a plurality of vibrating speeds/intensities 184. The electrical switch 170 may be utilized to electrically couple and decouple vibrating device 180 from the electric current source 160. As shown in FIGS. 15 and 20, the electrical switch 170 may be coupled exterior to the disk body 164 such that the tongue 18 of the individual 14 can be utilized for activating the electrical switch 170. The electrical switch 170 may be depressed by the tongue 18 multiple times for varying the plurality of vibrating speeds/intensities 184.

The housing aperture 148 may be utilized for inserting and removing the vibrating device 180 and the electric current source 160 from the housing chamber 141. The housing aperture 148 may include the aperture seal 149. The aperture seal 149 may include a gluing, an overlap channel closure or other forms of sealing.

The oral stimulating device 10 may include the electric light emitting device 150, the vibrating device 180 and the electric current source 160 within the disk body 164 and positioned into the housing 140 for emitting light radiation 152 thru the transparent material 136 and emitting vibration 182.

FIGS. 22-35 illustrate an alternative embodiment of the present invention. A primary grid 200 extends between the primary interior wall 50 and the primary exterior wall 54. The primary grid 200 includes a primary plurality of apertures 202. The upper surface 44 of the primary member 40, the primary interior wall 50, the primary exterior wall 54 and the primary grid 200 defines a primary channel cavity 204.

A secondary grid 210 extends between the secondary interior wall 70 and the secondary exterior wall 74. The secondary grid 210 includes a secondary plurality of apertures 214. The upper surface 64 of the secondary member 60, the secondary interior wall 70, the secondary exterior wall 74 and the secondary grid 210 define a secondary channel cavity 214.

An arcuate grid 220 extends between the arcuate interior wall 90 and the arcuate exterior wall 94. The arcuate grid 220 includes a third plurality of apertures 222. The upper surface 84 of the arcuate member 80, the arcuate interior wall 90, the arcuate exterior wall 94 and the arcuate grid 220 define a third channel cavity 224.

The primary grid 200, the secondary grid 210 and the arcuate grid 220 defining a general U-shaped grid 230. The primary channel cavity 204, secondary channel cavity 214 and the third channel cavity 224 define a general U-shaped mouthpiece cavity 232. As best seen in FIGS. 29-35, a curable material 240 encircles the general U-shaped grid 230, enters the general U-shaped mouthpiece cavity 232 and impresses with the upper teeth 16. Once the curable material 240 cures, the curable material 240 defines a molded coupling 246 between the general U-shaped mouthpiece 30 and the upper teeth 16. The molded coupling 246 prevents displacement of the general U-shaped mouthpiece 30 relative to the upper teeth 16.

The curable material 240 may include a first part polyvinyl siloxane (PVS) 242 and a second part polyvinyl siloxane (PVS) 244 dispensed from a container and mixed by hand and then rolled into a preferably a general U-shaped mixture. The general U-shaped mixture is positioned above the general U-shaped grid 230. Thereafter the oral stimulating device 10 is inserted into the mouth 12 of the individual 14. The individual 14 then diverges the upper and lower jaw together for impressing the upper teeth 16 into the curable material 240. The curable material 240 traverses the general U-shaped grid 230 and is positioned within the general U-shaped mouthpiece cavity 232. Preferably the entire U-shaped mouthpiece cavity 232 is entirely enveloped by the curable material 240 four preventing the growth of bacteria therein. The curable material 240 further encircles the upper teeth 16 and provides an accurate contoured molding against the upper teeth 16.

In order to further facilitate the coupling between the curable material 240 and the general U-shaped mouthpiece 30 the oral stimulating device 10 may further include a primary J shaped edge 250 in the primary exterior wall 54. A secondary J shaped edge 252 is in the secondary exterior wall 74. A third J shaped edge 254 is in the arcuate exterior wall. The primary J shaped edge 250, the secondary J shaped edge 252 and the third J shaped edge 254 defines a general U-shaped J shaped edge 256. The general U-shaped J shaped edge 256 further couples the curable material 240 with the general U-shaped mouthpiece 30 by further preventing displacement of the curable material 240 relative to the general U-shaped mouthpiece 30.

The battery 162 that provides an electrical current to the vibrating device 180 may be recharged by a wireless charging system including but not limited to a magnetic resonance 260 or inductive power transfer (IPT) 262.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An oral stimulating device for inserting within a mouth of an individual and engaging over the teeth, the oral stimulating device adapted to contact a second individual, the oral stimulating device, comprising:

a primary member defining a lower surface, an upper surface, an interior surface and an exterior surface;

a secondary member defining a lower surface, an upper surface, an interior surface and an exterior surface;

an arcuate member defining a lower surface, an upper surface, an interior surface and an exterior surface;

said arcuate member coupling said primary member with said secondary member for defining a general U-shaped mouthpiece;

a first plurality of lower protruding knobs coupled to said lower surface of said primary member and configured to contact the second individual;

a second plurality of lower protruding knobs coupled to said lower surface of said secondary member and configured to contact the second individual;

a third plurality of lower protruding knobs coupled to said lower surface of said arcuate member and configured to contact the second individual; and said first plurality of protruding knobs, said second plurality of protruding knobs and said third plurality of protruding knobs adapted to provide oral stimulation, to the second individual.

2. The oral stimulating device as set forth in claim 1, further including a housing coupled to said interior surface of said primary member, said interior surface of said secondary member and said interior surface of said arcuate member;

said housing defining a lower surface, an upper surface and a rear surface;

a vibrating device and an electric current source within said housing for emitting vibration from said general U-shaped mouthpiece; and said emitting vibration adapted to provide oral stimulation.

3. The oral stimulating device as set forth in claim 2, further including a fourth plurality of lower protruding knobs coupled to said lower surface of said housing; and said fourth plurality of protruding knobs adapted to provide oral stimulation.

4. The oral stimulating device as set forth in claim 2, further including a housing aperture in said rear surface for inserting and removing said vibrating device and said electric current source relative to said general U-shaped mouthpiece.

5. The oral stimulating device for inserting within a mouth of an individual and engaging over the teeth, the oral stimulating device, comprising:

a primary member defining a lower surface, an upper surface, an interior surface and an exterior surface;

a secondary member defining a lower surface, an upper surface, an interior surface and an exterior surface;

an arcuate member defining a lower surface, an upper surface, an interior surface and an exterior surface;

said arcuate member coupling said primary member with said secondary member for defining a general U-shaped mouthpiece;

a housing coupled to said interior surface of said primary member, said interior surface of said secondary member and said interior surface of said arcuate member;

said housing defining a lower surface, an upper surface and a rear surface;

a vibrating device and an electric current source within said housing for emitting vibration from said general U-shaped mouthpiece; and said emitting vibration adapted to provide oral stimulation.

6. The oral stimulating device as set forth in claim 5, further including a primary interior wall coupled to said upper surface of said primary member;

a secondary interior wall coupled to said upper surface of said secondary member;

an arcuate interior wall coupled to said upper surface of said arcuate member;

a primary exterior wall coupled to said upper surface of said primary member;

a secondary exterior wall coupled to said upper surface of said secondary member;

an arcuate exterior wall coupled to said upper surface of said arcuate member;

said primary member, said primary interior wall and said primary exterior wall defining a primary channel;

said secondary member, said second interior wall and said secondary exterior wall defining a secondary channel;

said arcuate member, said arcuate interior wall and said arcuate exterior wall defining an arcuate channel; and said primary channel, said secondary channel and said arcuate channel adapted to encircle the teeth for preventing displacement of said general U-shaped mouthpiece relative to said teeth.

7. The oral stimulating device as set forth in claim 5, wherein said general U-shaped mouthpiece includes a thermo-plastic material for deforming said general U-shaped mouthpiece after heating and molding to fit the teeth of the individual for preventing displacement of said general U-shaped mouthpiece relative to said teeth.

8. The oral stimulating device as set forth in claim 5, wherein said general U-shaped mouthpiece includes a photoluminescence material for emitting light radiation.

9. The oral stimulating device as set forth in claim 5, wherein said general U-shaped mouthpiece includes a transparent material; and an electric light emitting device and an electric current source within said housing for emitting light radiation through said transparent material.

10. The oral stimulating device as set forth in claim 5, further including a housing aperture in said rear surface for inserting and removing said vibrating device and said electric current source relative to said general U-shaped mouthpiece.

11. An oral stimulating device for inserting within a mouth of an individual and engaging over the teeth, the oral stimulating device adapted to contact a sexual organ of a second individual, the oral stimulating device, comprising:

a general U-shaped mouthpiece for engaging the teeth of the individual;

a plurality of protruding knobs coupled to said general U-shape mouthpiece and configured to contact the sexual organ of the second individual;

a vibrating device and an electric current source within said general U-shaped mouthpiece for emitting vibration from said general U-shape mouthpiece and configured to transfer the vibration to the sexual organ of the second individual; and said plurality of protruding knobs and said emitting vibration adapted to provide oral stimulation to the sexual organ of the second individual.

12. An oral stimulating device for inserting within a mouth of an individual, the mouth of the individual having upper teeth and lower teeth, the oral stimulating device adapted to contact a second individual, the oral stimulating device, comprising:

a primary member defining an interior surface, an exterior surface and a primary channel;

a secondary member defining an interior surface, an exterior surface and a secondary channel;

an arcuate member defining an interior surface, an exterior surface and an arcuate channel;

said arcuate member coupling said primary member with said secondary member for defining a general U-shaped mouthpiece for engaging over the upper teeth or the lower teeth;

a first plurality protruding knobs coupled to said primary member and configured to contact the second individual;

a second plurality of protruding knobs coupled to said secondary member and configured to contact the second individual;

a third plurality of protruding knobs coupled to said arcuate member and configured to contact the second individual; and said first plurality of protruding knobs, said second plurality of protruding knobs and said third plurality of protruding knobs adapted to provide oral stimulation, to the second individual.

* * * * *